US005163577A

United States Patent [19]

Lee

[11] Patent Number: 5,163,577

[45] Date of Patent: Nov. 17, 1992

[54] MOBILE TRASH CONTAINER WITH PIVOTING HANDLES

[75] Inventor: Norman C. Lee, Greensboro, N.C.

[73] Assignee: Zarn, Inc., Reidsville, N.C.

[21] Appl. No.: 784,251

[22] Filed: Oct. 29, 1991

[51] Int. Cl.[5] ..... B65D 45/20

[52] U.S. Cl. ..... 220/318; 220/908; 220/765; 280/47.26

[58] Field of Search ..... 220/94 R, 318, 908; 280/47.26

[56] References Cited

U.S. PATENT DOCUMENTS

| | | | |
|---|---|---|---|
| 1,123,126 | 7/1938 | Urech | 220/318 |
| 1,312,626 | 8/1919 | Grannis | 220/318 |
| 1,698,929 | 1/1929 | Wentorf | 220/318 |
| 3,416,701 | 12/1968 | Kramer et al. . | |
| 3,464,586 | 9/1969 | Hitzeroth | 220/94 R |
| 3,988,802 | 11/1976 | Bruni et al. | 220/94 R |
| 4,157,763 | 6/1979 | Betlejewski et al. . | |
| 4,279,357 | 7/1981 | Robinson . | |
| 4,600,113 | 7/1986 | DeMars | 220/908 |
| 4,691,840 | 9/1987 | Ferbrache . | |
| 4,775,072 | 10/1988 | Lundblade et al. | 220/94 R |
| 4,819,827 | 4/1989 | DiSesa . | |
| 4,878,592 | 9/1989 | Lee . | |
| 5,022,546 | 6/1991 | Bock | 220/908 |
| 5,056,424 | 10/1991 | Lai | 220/94 R |
| 5,075,925 | 12/1991 | Maloney | 280/47.26 |

FOREIGN PATENT DOCUMENTS

| | | | |
|---|---|---|---|
| 81234 | 5/1919 | Switzerland | 220/318 |

OTHER PUBLICATIONS

"The Unbreakables", Tucker Housewares Catalog, 1985, pp. 6–8.

Rubbermaid Canada, Inc., Catalog p. 21, 1986.

Zarn Tough brochure featuring blow-molded plastic trash containers, pp. 1–4.

*Primary Examiner*—Stephen Marcus
*Assistant Examiner*—S. Castellano
*Attorney, Agent, or Firm*—Shefte, Pinckney & Sawyer

[57] ABSTRACT

An apparatus for the collection of refuse including a wheeled container having an interior compartment which can be covered by a removable lid, the lid being held in place by pivoting handles, the handles being limited in their pivoting movement by stop members for enhanced control during tipping and rolling movement of the container.

5 Claims, 6 Drawing Sheets

MOBILE TRASH CONTAINER WITH PIVOTING HANDLES

BACKGROUND OF THE INVENTION

The present invention relates broadly to trash receptacles and more particularly to a mobile trash container with pivoting handles which provide enhanced control of rolling movement of the container.

With the advent of curbside trash pick-up, home owners have become faced with the problem of carrying trash containers from the house to the curb. Once a task performed by garbage collectors, homeowners contended with often heavy and certainly bulky trash containers, and were thus periodically faced with the task of wrestling the awkward objects into position for collection at curbside. In addition, gardeners and others engaged in yard maintenance often use trash containers to gather lawn clippings and other yard debris. These individuals are also faced with carrying bulky containers around the yard. To this end, wheels were added near the base area of trash containers for rolling the container between necessary locations. Typically, the wheels are spaced a distance away from the lowermost portion of the container so that the container can stand upright on its base when necessary and can be tipped over onto its wheels for rolling movement.

Conventional wheeled trash containers have freely pivoting handles near the upper portion of the container to hold a lid in place when in a vertical position and to allow removal of the lid when pivoted outwardly. Disadvantageously, however, when the container is heavily loaded, the handles are difficult to use for tipping and rolling the container because the load resists tipping of the container and, instead, handles tend to pivot outwardly from the body of the container without tipping the container. Moreover, even with the container tilted for rolling movement, the relatively free pivotability of the handles results in diminished control of the container while being rolled.

SUMMARY OF THE INVENTION

It is accordingly an object of the present invention to provide a trash container with pivoting handles which solves the aforementioned problems. Specifically, it is an object of the present invention to provide a trash container with pivoting handles which limits the movement of the handles thereby providing enhanced control of the trash container during rolling movement thereof.

The trash container of the present invention basically comprises a container body which defines an interior receiving area, a first end of the container body defining an access opening into the interior receiving area and a second end of the container body being closed. A lid for attachment to and detachment from the first end of the container body is included. In addition, wheels are mounted to the closed end for rolling movement of the container. The container further includes a handle assembly mounted to the container body for movement between a first position wherein the handle assembly is generally upright for retaining the lid in place on the first end of the container body and a second position wherein the handle assembly is spaced just sufficiently outwardly from the first position for removal of the lid from the first end of the container body. According to the present invention, a stop arrangement is provided for limiting the movement of the handle assembly outwardly beyond the second position for enhanced stability and control of rolling movement of the container through the handle assembly.

According to one preferred embodiment of the present invention, the handle assembly is pivotably mounted to the container for pivotal movement between the first and second positions about a generally horizontal axis, and the limiting arrangement includes a stop member mounted to the handle assembly and projecting generally downwardly beyond the pivot axis for engagement with the container body when the handle assembly is at its second position to prevent movement of the handle assembly beyond the second position. The handle assembly preferably includes a handle member having laterally spaced arms, each of the arms having a stop member projecting downwardly therefrom. As desired, a pair of the handle assemblies may be mounted on opposite sides of the container body.

According to an alternate embodiment of the present invention, the handle assembly is pivotably mounted to the container body for pivotal movement between the first and second positions about a generally horizontal axis and the limiting arrangement includes a limit member mounted to the container body for engagement with the handle assembly at the second position to prevent movement of the handle assembly beyond the second position. The handle assembly preferably includes laterally spaced arms and the limit member is oriented generally horizontally and mounted above the pivot axis for engagement with the laterally spaced arms when the handle assembly is at its second position to prevent movement of the handle assembly beyond its second position. As in the first embodiment, a pair of the handle assemblies may be mounted to opposite sides of the container body.

DESCRIPTION OF THE PREFERRED EMBODIMENT

Figure 1:
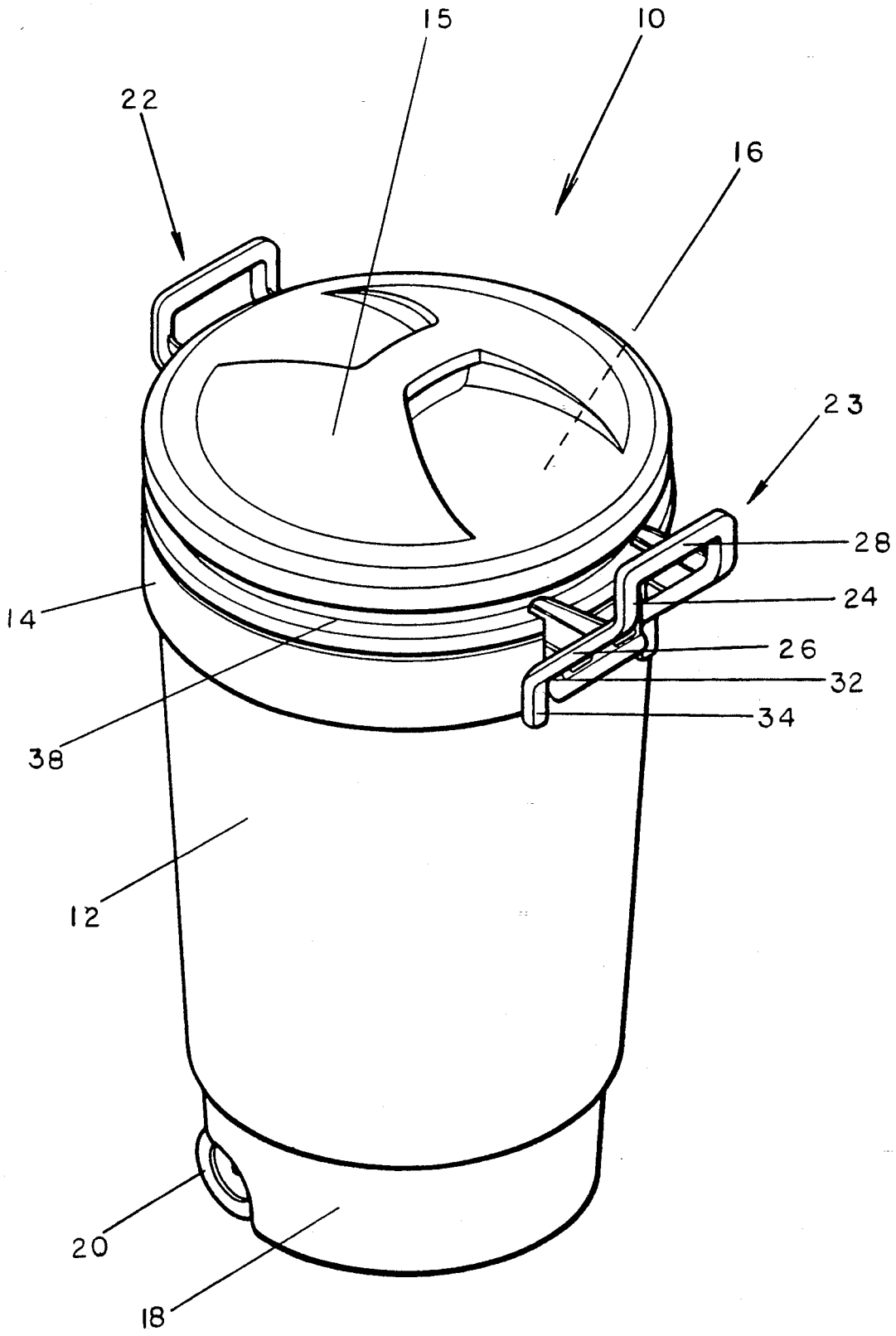
FIG. 1 is a perspective view of a mobile trash container with pivoting handles according to one preferred embodiment of the present invention.

Referring now to the accompanying drawings and initially to FIG. 1, a trash container with pivoting handles according to the preferred embodiment of the present invention is indicated generally at 10 and includes a main container body 12 defining an interior receiving area 17 for containing trash and the like therein. The container body 12 has an annular container wall 13 terminating at its upper end in a rim 14 defining an access opening 16 into the interior area 17 and merging at its lower end with a closed base 18 having wheels 20 rotatably attached at one lateral side thereof. A removable lid 15 is provided for placement on the rim 14 to cover the opening 16 and enclosed the container interior 17. A handle assembly 22 is mounted to the annular wall 13 of the container body 12 immediately adjacent the rim 17 directly above the location of the wheels 20 and, preferably, a corresponding handle assembly 23 is mounted to the annular wall 13 diametrically opposite the handle assembly 22.

Figure 2:
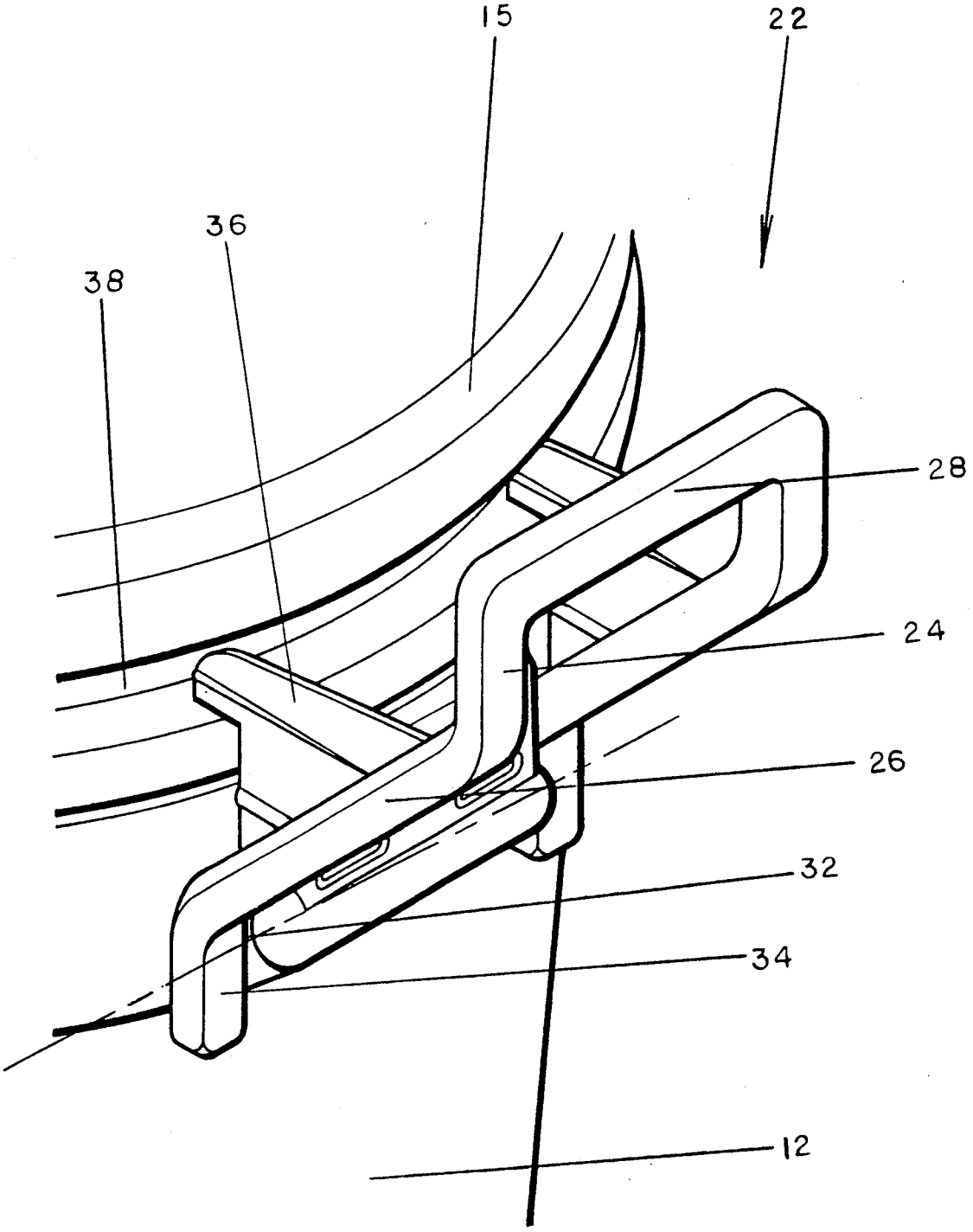
FIG. 2 is an enlarged perspective view of one handle of the trash container as illustrated in FIG. 1.

With reference to FIG. 2, the handle assembly 22 includes a handle member 24 of a generally inverted U-shape having downwardly projecting arm portions 26 and a traverse gripping portion 28. The arm portions 26 of the handle member 24 are pivotably mounted to the annular wall of the container body 12 about a horizontal pivot axis 32 adjacent the access opening 16. The arm portions 26 of the handle member 24 include stop members 34 projecting downwardly from each arm portion 26 below the pivot axis 32 for engagement with the container body 12 upon pivotal movement of the handle 24 outwardly from the container body 12.

Figure 3:
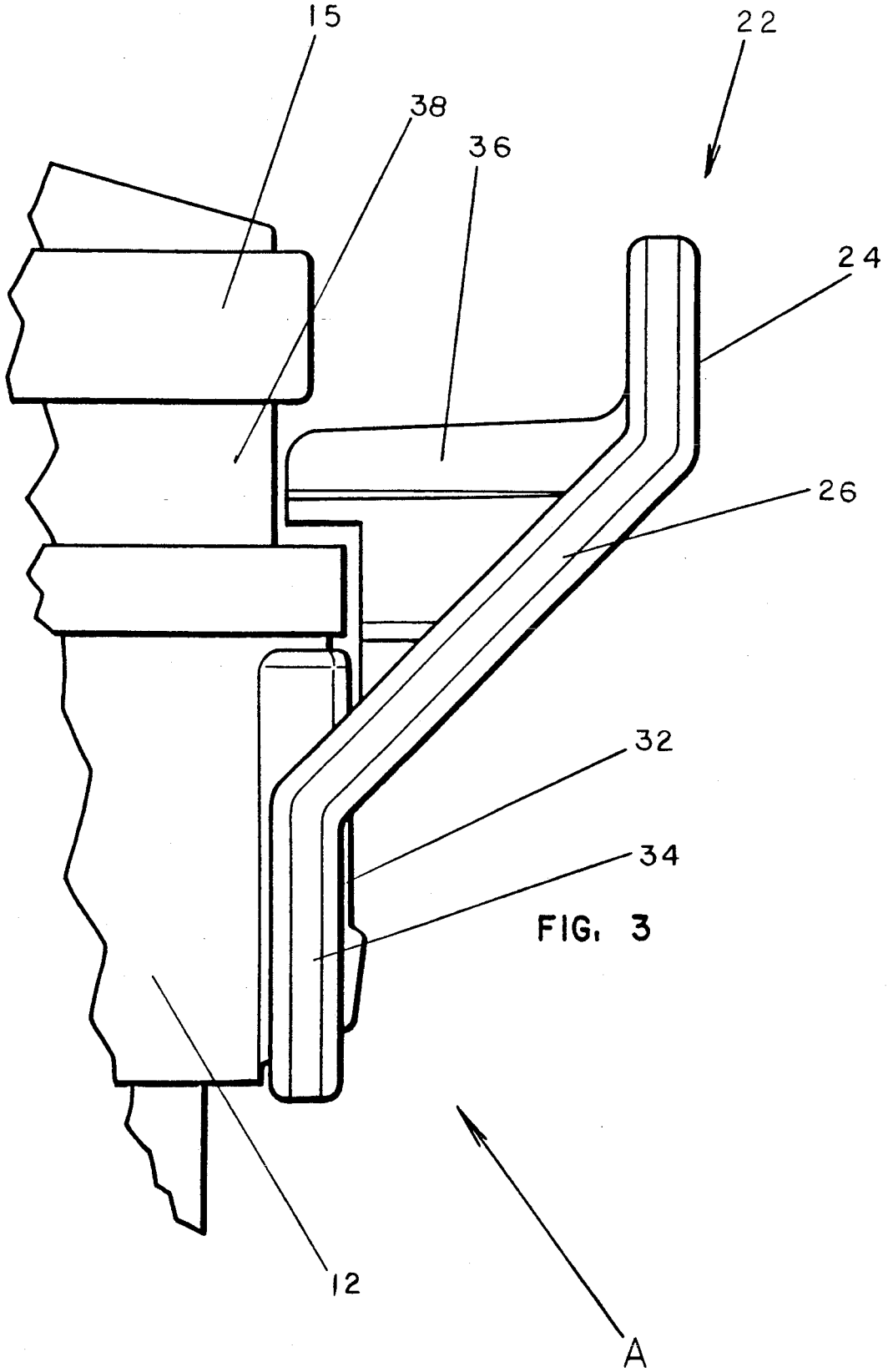
FIG. 3 is a side view of the handle of FIG. 2 in its first position.

With reference to FIG. 3, the handle assembly 22 is illustrated in its closed position A wherein the handle member 24 is in its most vertically upright disposition for retaining the lid 15 in place. The handle assembly 22 includes a pair of lid retaining members 36 which project radially inwardly generally toward the center of the trash container body 12 and are disposed partially within a groove 38 formed in the lid 15 when the handle assembly 22 is in its first position A.

Figure 4:
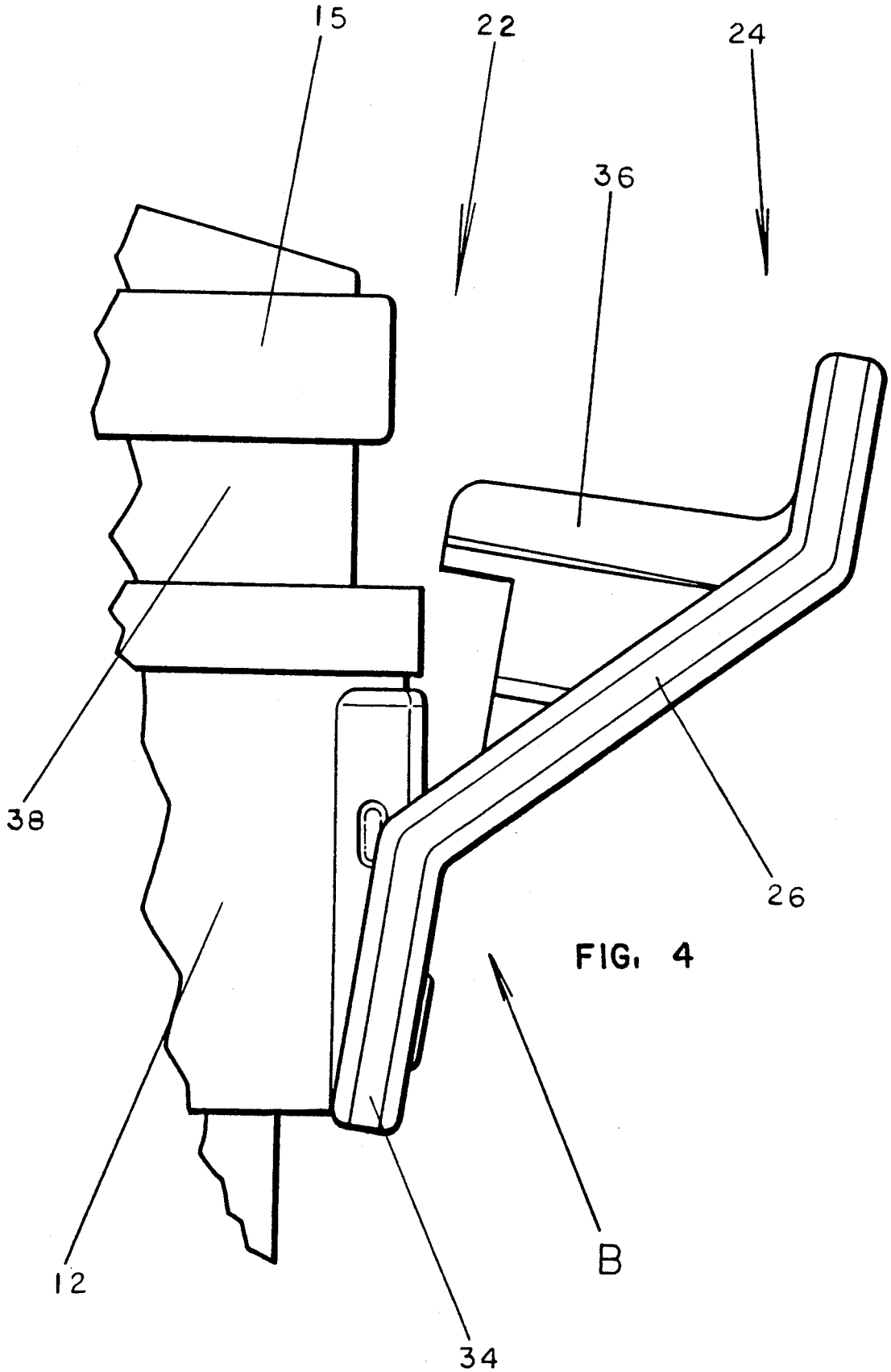
FIG. 4 is a similar side view of the handle of FIG. 2 in its second position.

Referring now to FIG. 4, the handle assembly 22 is shown to be pivoted outwardly from the container body 12 to an open position B wherein the lid retaining members 36 are spaced outwardly from the groove 38 just sufficiently to permit the lid 15 to be removed from and placed on the rim 14. In this position B, the stop members 34 are pivoted inwardly to engage the container body 12 to thereby limit any further outward pivoting movement of the handle assembly 22 beyond such position B.

The user may also utilize the handle assembly 22 to tip the container 10 onto its wheels 20 and to pull the container 10 for rolling movement thereof. The limited travel distance between the first handle position A and the second handle position B is effective to sufficiently stabilize and rigidify the handle assembly 22 with respect to the container body 12 to facilitate relatively easy tipping of the container 10 even when heavily loaded and to provide enhanced control of the container 10 when rolling movement is initiated and in progress.

Figure 5:
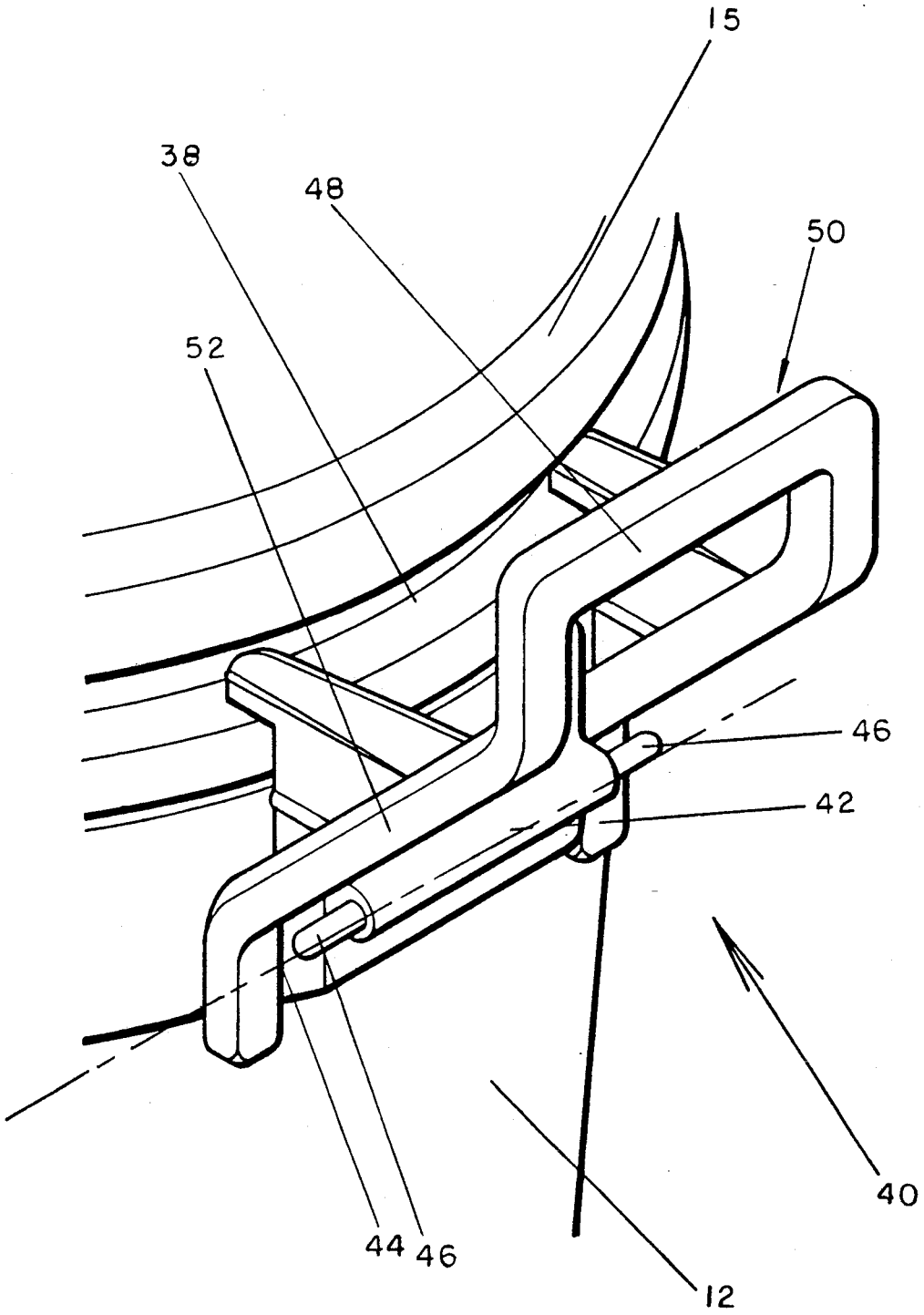
FIG. 5 is an enlarged perspective view of one pivoting handle of a trash container according to an alternate embodiment of the present invention.

With reference to FIG. 5, an alternate embodiment of the handle assembly according to the present invention is indicated generally at 40 and is of substantially the same configuration as the handle member 24 of FIGS. 1–4, having a handle member 50 of inverted U-shape including two downwardly projecting arms 52 and a traverse gripping portion 48 and with lid retaining members 54 extending radially inwardly from the handle member 50. The arms 52 of the handle assembly 40 are pivotally mounted to the container body 12 adjacent the rim 14 about a horizontal pivot axis 44. A limit member 42 is horizontally mounted to the container body 12 above and radially outwardly spaced from the pivot axis 44. The limit member 42 includes end portions 46 which project into the path of pivoting movement of the arms 52 of the handle member 50.

Figure 6:
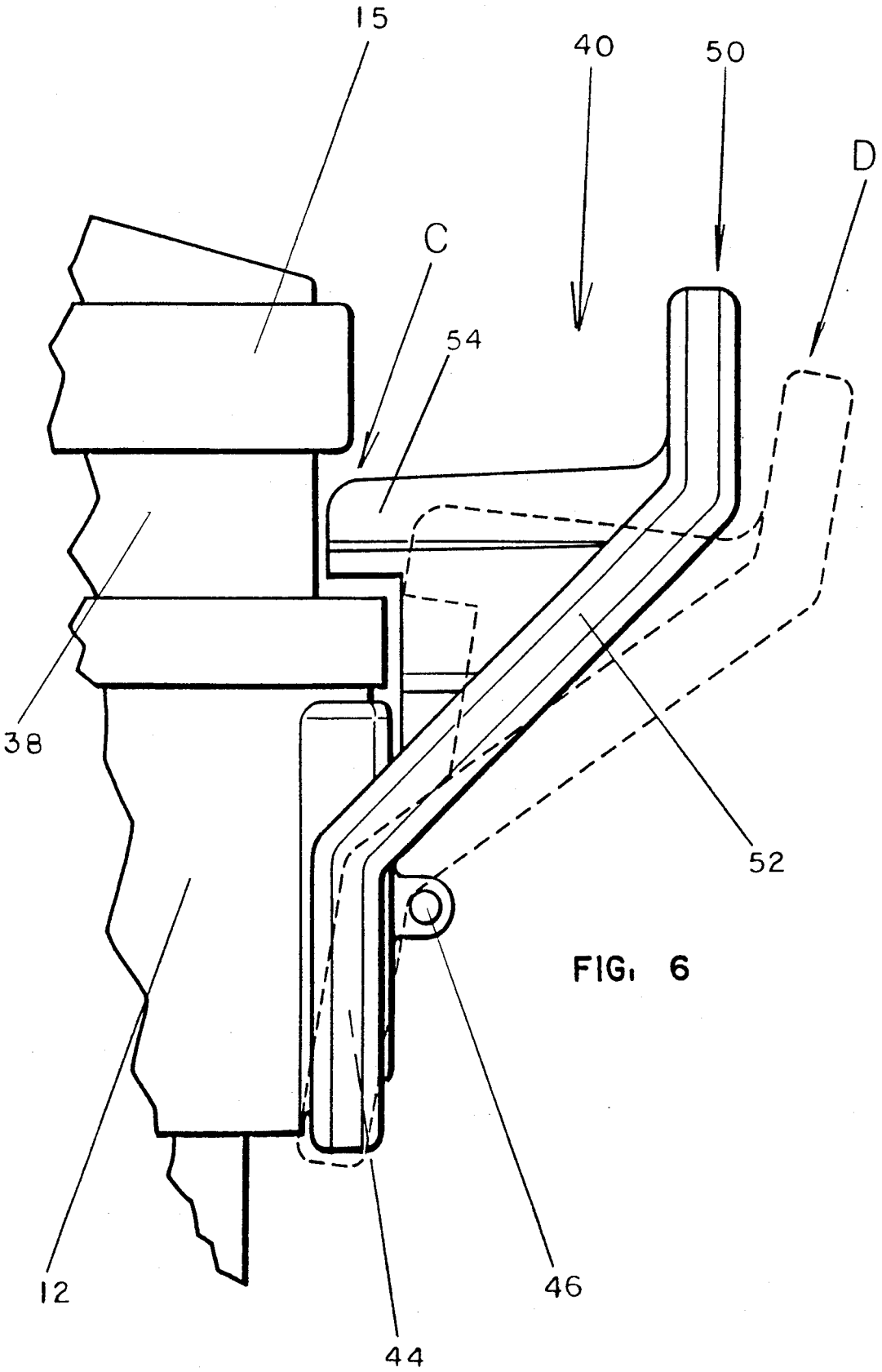
FIG. 6 is a side view of the handle of the trash container of FIG. 5 wherein its first position is depicted by solid lines and its second position is depicted by broken lines.

As seen in FIG. 6, the handle member 50 may be pivoted about the pivot axis 44 for movement between a closed position C wherein the handle member 50 is substantially upright with the lid retaining members 54 disposed for retaining the lid 15 in position, and an open position D, wherein the handle member 50 is pivoted just sufficiently outwardly so that the lid 15 may be removed from and placed on rim 14 of the container body 12. When the handle member 50 reaches the second position D, the downwardly projecting arms 52 contact the limit member 42 preventing further pivotal movement of the handle portion 50.

In the use of either embodiment of the handle assembly, a user will grip the traverse gripping portion 28,48 of the handle members 24,50 and exert a force sufficient to tip the container body 12 onto the wheels 20. The respective stop or limit members 34,46 prevent the handle member 24,50 from moving farther than is just necessary for permitting removal and replacement of the lid 15. Advantageously, the limited range of pivoting movement of either handle member 24,50 enables the user to tip and roll the container with relative ease, even when under heavy load without loss or inhibition of control due to excessive handle movement.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for collection of refuse comprising a container body which defines an interior receiving area, a first end of said container body defining an access opening into said interior receiving area and a second end of said container body being closed; a lid for attachment and detachment to and from said first end of said container body; wheel means mounted at said closed end for rolling movement of said container body; handle means pivotably mounted to said container body for pivotal movement about a generally horizontal axis between a first position wherein said handle means is generally upright for retaining said lid in place on said first end of said container body and a second position wherein said handle means is spaced just sufficiently outwardly from said first position for attachment and removal of said lid from said first end of said container body; and means for limiting said movement of said handle means outwardly beyond said second position for enhanced stability and control of rolling movement of said container apparatus through said handle means, said limiting means including a stop member mounted to said handle means and projecting generally downwardly beyond said pivot axis for engagement with said container body when said handle means is at its second position to prevent movement of said handle means beyond said second position.

2. An apparatus for collection of refuse according to claim 1 wherein said handle means includes laterally spaced arms, each said arm having one said stop member projecting downwardly therefrom.

3. An apparatus for collection of refuse according to claim 2 wherein a pair of said handle means are mounted on opposite sides of said container body.

4. An apparatus for collection of refuse comprising a container body which defines an interior receiving area, a first end of said container body defining an access opening into said interior receiving area and a second end of said container body being closed; a lid for attachment and detachment to and front said first end of said container body; wheel means mounted at said closed end for rolling movement of said container body; handle means pivotably mounted to said container body for pivotal movement about a generally horizontal axis between a first position wherein said handle means is generally upright for retaining said lid in place on said first end of said container body and a second position wherein said handle means is spaced just sufficiently outwardly from said first position for attachment and removal of said lid from said first end of said container body, said handle means including laterally spaced arms; and means for limiting said movement of said handle means outwardly beyond said second position for enhanced stability and control of rolling movement of said container apparatus through said handle means, said limiting means including a limit member oriented generally horizontally and mounted to said container body above said pivot axis for engagement with said laterally spaced arms when said handle means is at its second position to prevent movement of said handle means beyond its second position.

5. An apparatus for collection of refuse according to claim 4 wherein a pair of handle means are mounted to opposite sides of said container body.

* * * * *